United States Patent [19]

Graebe

[11] Patent Number: 4,698,864

[45] Date of Patent: Oct. 13, 1987

[54] CELLULAR CUSHION

[76] Inventor: Robert H. Graebe, 4 Signal Hill Blvd., Belleville, Ill. 62223

[21] Appl. No.: 801,484

[22] Filed: Nov. 25, 1985

[51] Int. Cl.[4] ..... A47C 20/02; A47C 27/10

[52] U.S. Cl. ..... 5/441; 5/455; 5/464; 297/DIG. 3

[58] Field of Search ..... 5/449, 453–456, 5/458, 464, 436, 441; 297/458, 459, DIG. 3

[56] References Cited

U.S. PATENT DOCUMENTS

| | | | |
|---|---|---|---|
| 1,468,072 | 9/1923 | Ogle | 5/441 |
| 1,746,953 | 2/1930 | McCollum | 5/449 |
| 2,136,510 | 11/1938 | Jensen | 5/456 |
| 2,260,437 | 10/1941 | Chambers | 5/441 |
| 2,838,099 | 6/1958 | Warner | 5/455 |
| 3,112,956 | 12/1963 | Schick et al. . | |
| 3,192,540 | 7/1965 | Swank | 5/456 |
| 3,605,145 | 9/1971 | Graebe . | |
| 3,740,773 | 7/1973 | Dee . | |
| 3,870,450 | 3/1975 | Graebe | 425/269 |
| 3,982,786 | 9/1976 | Burgin et al. | 5/453 |
| 4,005,236 | 1/1977 | Graebe | 5/455 |
| 4,161,794 | 7/1979 | Darnfors | 5/455 |
| 4,370,769 | 2/1983 | Herzig et al. | 5/452 |
| 4,422,194 | 12/1983 | Viesturs et al. | 5/455 |
| 4,541,136 | 9/1985 | Graebe | 5/456 |
| 4,592,589 | 6/1986 | Hellwig | 5/441 |

*Primary Examiner*—Gary L. Smith
*Assistant Examiner*—Michael F. Trettel
*Attorney, Agent, or Firm*—Gravely, Lieder & Woodruff

[57] ABSTRACT

A cushion has a base and a plurality of flexible hollow cells attached to the base and projected outwardly from it. The cells may be arranged in zones, with the interiors of the cells for each zone being in communication, yet isolated from the interiors of the cells for the other zones. The cells are inflated slightly to support a load applied to the cushion, and when the cushion is so loaded, the cells of each zone are at the same pressure, so that the supporting force exerted by each cell of a particular zone against the load is essentially the same. The cells may be of varying length to contour the surface formed by the ends of the cells, giving that surface, for example, a wedge-shaped configuration or a cradle-like configuration. Some of the cells may be separated more than others to provide the cushion with a cavity where no support is provided, and the cavity may extend through the base.

1 Claim, 12 Drawing Figures

FIG. 4
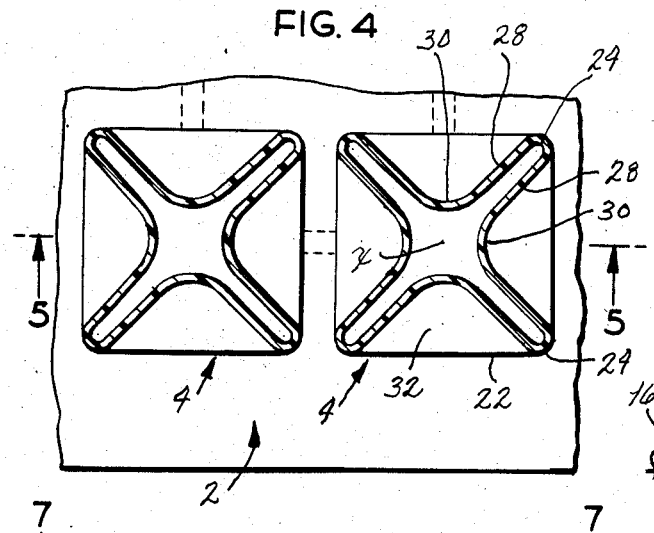
FIG. 5
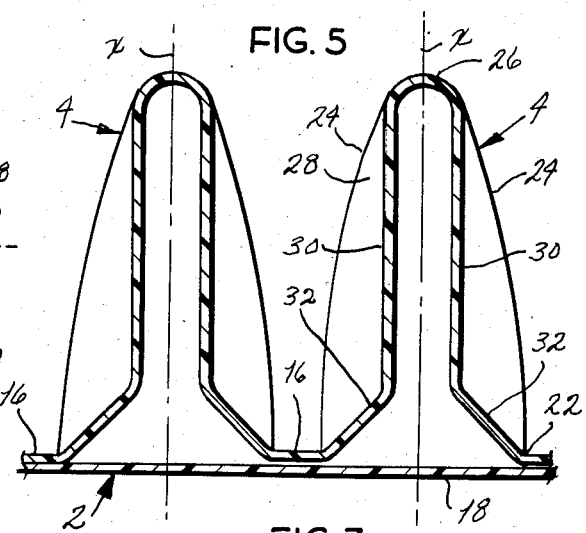
FIG. 6
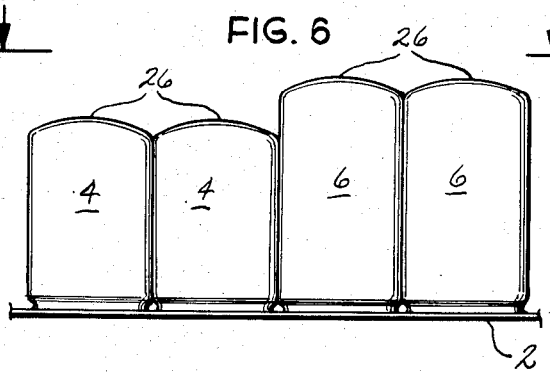
FIG. 7
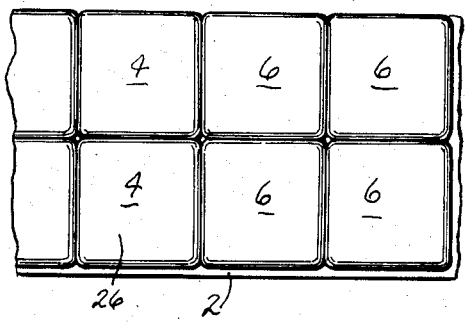
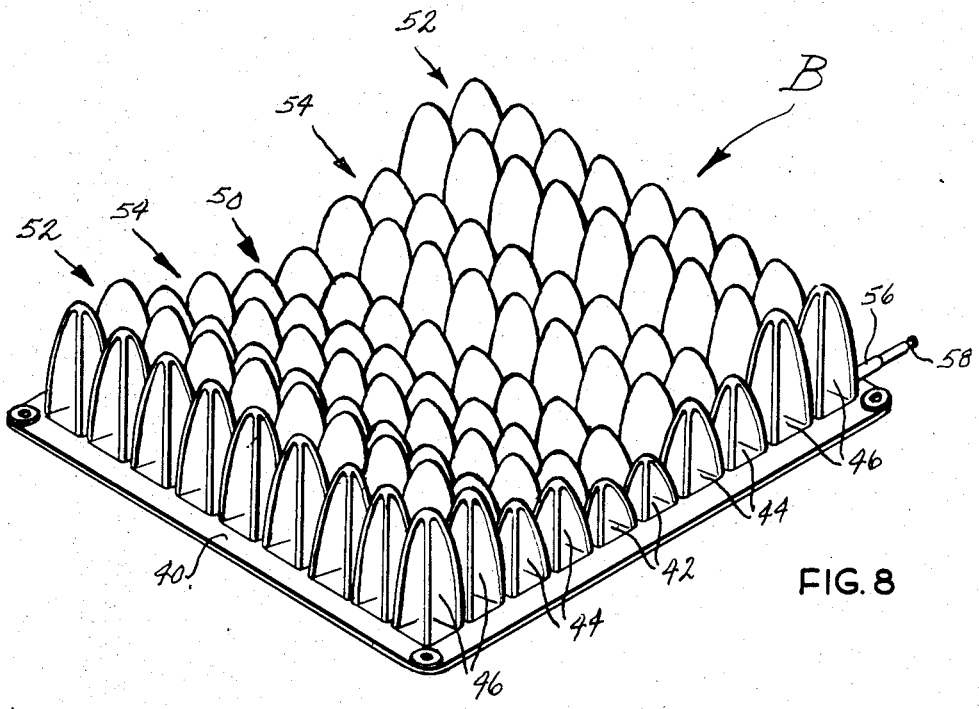
FIG. 8

CELLULAR CUSHION

BACKGROUND OF THE INVENTION

This invention relates to cushioning devices, and more particularly to cushions having inflatable cells.

Those individuals who for one reason or another are confined to sitting or reclining positions for extended periods of time exhibit a tendency to develop decubitus ulcers, more commonly known as bed or pressure sores, and this of course is the result of inadequate blood circulation at the skin area where the body is supported. For example, the weight of a person sitting in a wheel chair is transferred primarily through the buttocks to the skeletal system, with most of the weight being concentrated at the bony prominances of the buttocks. It is in this region that the skin tissue is likely to break down and cause pressure sores.

Of course, the tendency for pressure sores to develop may be lessened considerably by distributing the weight of the body more uniformly over the supporting device on which the body rests, whether that device be a seat cushion or mattress, and to this end cellular cushions have been developed. These cushions have closely spaced flexible air cells which project from a common base through which their interiors are connected, so that the base serves as manifold. With only minimal inflation, the cells will support an individual, and indeed will spread out over the surface area of that portion of the body which sinks into the cushion so that the body weight distributes uniformly over the cushion. A cushion of the foregoing construction forms the subject of U.S. Pat. No. 4,541,136.

While cellular cushions have reduced the incidence of pressure sores, such cushions do on occasion present problems, most of which are peculiar to specific users. For example, some individuals have a tendency to slide forwardly on such cushions, while others have difficulty lifting either sideways or forwardly off of them. With still others, certain areas of their bodies are so sensitive that they should not be subjected to any forces or contact whatsoever, even a uniformly distributed force of the type provided by a cellular cushion. Some individuals have skeletal disfigurations or infirmities which are only aggravated by cushions of the conventional configuration and orientation. The foregoing problems exist irrespective of whether cellular cushions are used for supporting purposes, or merely as backrests.

SUMMARY OF THE INVENTION

One of the principal objects of the present invention is to provide a cellular cushion which is configured to facilitate a particular end, such as better containment of a body that is against it, or to perhaps facilitate movement onto or off of the cushion, all while distributing loads generally uniformly over the body surface area that is against the cushion. Another object is to provide a cushion which may be adjusted to properly position and accommodate a body that is supported on it. A further object is to provide a cushion having its cells arranged in zones, with the zones being independent so as to be capable of existing at different pressures and perhaps elevations as well. An additional object is to provide a cushion of the type stated having cells of varying length. Still another object is to provide a cushion of the type stated having cavities in its array of air cells. Yet another object is to provide a process for correcting deformities in posture by varying the pressure in cells of a cushion in which the cells are arranged in fluid isolated zones. These and other objects and advantages will become apparent hereinafter.

DESCRIPTION OF THE DRAWINGS

In the accompanying drawings which form part of the specification and wherein like numerals and letters refer to like parts wherever they occur:

FIG. 4 is a sectional view of the cells taken along line 4—4 of FIG. 2;

FIG. 5 is a sectional view of the cells taken along line 5—5 of FIG. 4;

FIG. 6 is an elevational view of the cells inflated;

FIG. 7 is a plan view of the cells pressurized

FIG. 8 is a perspective view of a modified cushion having cradle-like supporting surfaces;

DETAILED DESCRIPTION

Figure 1:
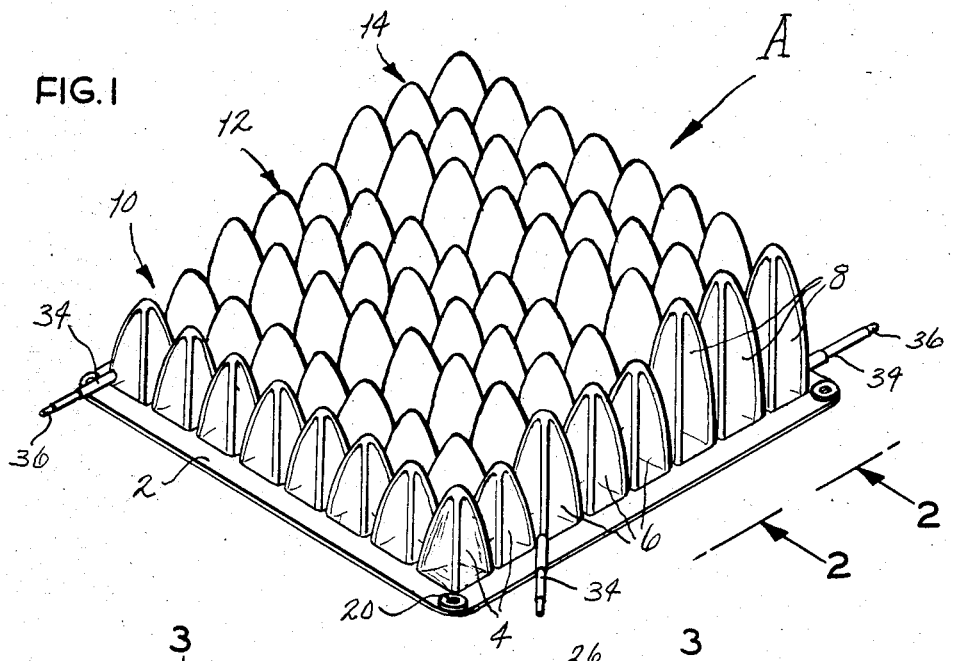
FIG. 1 is a perspective view of a multizoned cushion constructed in accordance with and embodying the present invention.

Referring now to the drawings, a cellular cushion 4 (FIG. 1) has a base 2 and flexible cells 4, 6 and 8 projecting from one surface of the base 2 so as to present a deformable supporting surface on which a portion of the human body may rest. Indeed, when the cells 4, 6 and 8 are properly inflated, the supported body will sink into the array of cells 4, 6 and 8 so that the supporting surface formed by the ends of those cells generally conforms to the portion of the body that is against it. The cells 4 are together in the array, as are the cells 6 and the cells 8, so as to provide three different zones 10, 12 and 14 within the cushion A. Moreover, the cells 4 of the zone 10 are of equal height, as are the cells 6 of the zone 12 and the cells 8 of the zone 14. However, the cells 4, 6 and 8 are of different height. Finally, the interiors of the cells 4 in the zone 10 are in communication with each other but not with respect to the cells 6 and 8 of the zones 12 and 14, and this holds true for the cells 6 of the zone 12 and the cells 8 of the zone 14, so that the cells 4, 6 and 8 within each zone 10, 12 and 14 exist at a uniform pressure which may, and most likely does, vary from zone to zone.

Figure 2:
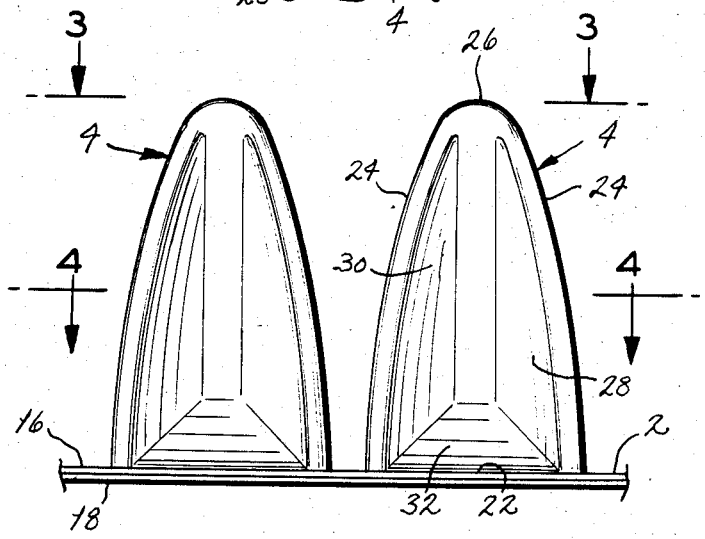
FIG. 2 is an elevational view taken along line 2—2 of FIG. 1 showing typical cells unpressurized within the cushion.
Figure 3:
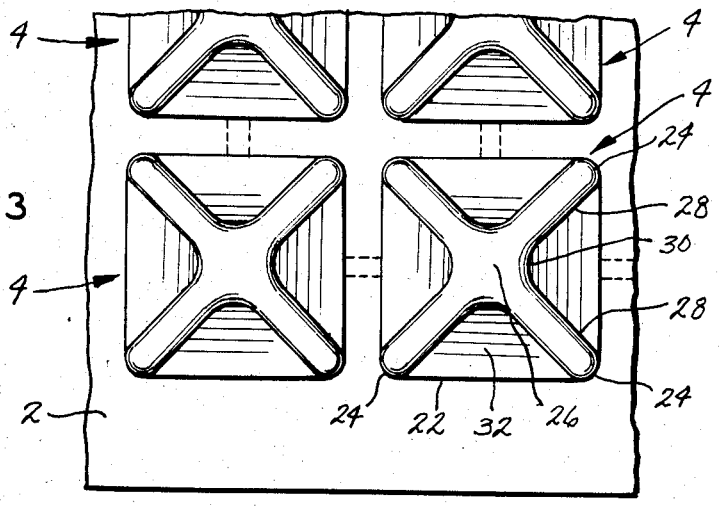
FIG. 3 is a plan view of the cushion taken along line 3—3 of FIG. 2.

The base 2 consists of an upper sheet 16 and a lower sheet 18 (FIGS. 2 & 5) of a flexible material, preferably an elastomer. The two sheets 16 and 18 are bonded together along their peripheries, which are in registration and are further bonded together intermediate the cells 4, 6 and 8 which project from the upper sheet 16. Indeed, the bond between the two sheets 16 and 18 is continuous, that is air tight, along the registered peripheries of the two sheets 16 and 18 and also between the zones 10, 12 and 14, but is discontinous within each of the zones 10, 12 and 14, so that the cells 4 within the zone 10 communicate with each other, the cells 6 within the zone 12 likewise communicate, and so do the cells 8 in the zone 14. By reason of the total isolation of the cells 4, 6 and 8 of the three zones 10, 12 and 14 from each other, the upper sheet 16 of the base 2 may be a composite of three individual sheets— one for each zone 10, 12 and 14, with the upper sheet 16 for each zone of course being sealed continuously along its periphery to the underlying lower sheet 18. The base 2 at its corners has grommets 20 which pass through the two sheets 16 and 18.

The cells 4, 6 and 8 are formed integral with the upper sheet 16 of the base 2 (FIG. 5), so that their hollow interiors open out of the sheet 16 toward the underlying sheet 18. Moreover, the cells 4, 6 and 8 within any zone are arranged in rows which extend transversely across the base 2 (FIG. 1), there being in a typical wheel chair cushion two rows of short cells 4 in the zone 10, three rows of intermediate length cells 6 in the zone 12, and three rows of the long cells 8 in the zone 14. Not only are the cells 4, 6 and 8 arranged transversely in rows, but they are also arranged longitudinally in rows, with each longitudinal row containing two short cells 4, three intermediate cells 6 and likewise three long cells 8. In the typical seating cushion the short cells 4 may be about two inches from end-to-end, when inflated, the intermediate cells 6, 3 inches and the long cells 8, 4 inches.

The cells 4, 6 and 8 are similar in configuration, but differ in length, and as a consequence only the cells 4 will be described. Each cell 4 has an axis x (FIGS. 4 & 5) about which it is radially symmetrical, that axis being normally perpendicular to the base 2. The cell 4 merges into the cushion base 2 at a cell base 22 (FIGS. 2–5) possessing a square-shaped configuration, with two of its sides being parallel to the transverse rows and the other two being parallel to the longitudinal rows. Each cell 4 further has four fins 24 which extend outwardly from the four corners of the cell base 22 generally parallel to the axis x, and near the opposite end of the cell 4 converge into an end wall 26 which is centered along the axis x. Each fin 24 has parallel side walls 28 which are closely spaced, and the side walls 28 of adjacent fins 24 merge at arcuate connecting segments 30 which are located close to the axis x. The connecting segments 30 at their outer ends merge into the end wall 28 along with the fins 24. At their inner ends, the connecting segments 30 merge into oblique walls 32 which extend downwardly to the margins of the cell base 22, oblique to the axis x as their name implies. The configuration of the cell 4 is more completely described in U.S. Pat. No. 4,541,136. The cells 4 and likewise the cells 6 and 8 may have other configurations as well.

One of the short cells 4 for the zone 10 is provided with a short fill tube 34 (FIG. 1) having a manually operated valve 36 at its end. Likewise one of the intermediate cells 6 has a fill tube 34 and valve 36 and so does one of the long cells 8. Thus, a fill tube 34 and valve 36 exists for each of the zones 10, 12 and 14 and through the valves 36 of the fill tube, the cells 4, 6 and 8 of the zones 10, 12 and 14, respectively, may be inflated. Moreover, by manipulating the valves 36, the volume of air within the zones 10, 12 and 14 may be regulated.

To prepare the cushion for use, the cells 4, 6 and 8 are inflated by pumping air into the fill tubes 34 for the zones 10, 12 and 14 in which they are located and then closing the valves 36 on those tubes 34. As each cell 4, 6 and 8 inflates, its connecting segments 30 move laterally away from center axis x, carrying the fin side walls 28 and the oblique walls 32 outwardly with them. Indeed, the cells 4, 6 and 8 assume a somewhat cubic configuration (FIGS. 6 & 7), with the sides of one cell being against the sides of the cell adjacent to it. Moreover, the lateral expansion of the cells enlarges their end walls 26 so that the end walls 26 for the array of cells 4, 6 and 8 forms a generally continuous supporting surface which for the most part obliterates the voids that exist between the cells 4, 6 and 8 at the base 2.

To inflate the cushion, one attaches a pump to the valve 36 of each zone 10, 12 and 14, and with the valve 36 open pumps air into the cells of that zone until the cells are slightly overinflated (FIGS. 6 & 7). Then the valve 36 is closed to trap the air within the cells of the zone. Once the cells 4, 6 and 8 of all three zones 10, 12 and 14 are filled, the user sits on the cushion A in the position he or she would be expected to use it. Thereupon the valves 36 for the three zones 10, 12 and 14 are opened so that air escapes slowly. As a result, the user settles into the cushion and his or her weight becomes more uniformly distributed over the area of the body in contact with the cushion. Ideally the user should settle to within about ½ to 1 inches of the base 2, at which time the valves 36 are closed. Of course, by manipulating the three valves 36, it is possible to somewhat distribute the supporting load between the three zones 10, 12 and 14 as desired.

Since the cells are arranged in the zones 10, 12 and 14, with the cells 8 of the zone 14 longer than the cells 6 of the adjacent zone 12 which are in turn longer than the cells 4 of the next zone 10, the cushion A is somewhat wedge-shaped. This serves several useful functions, particularly when used as the seating surface for a wheelchair. For example, if the wheelchair occupant is weak and does not have the strength to retain his or herself in the wheelchair, the cushion A should be positioned with the zone 10 of short cells 4 closest to the backrest, and this of course presents the long cells 8 forwardly at the front edge of the seat. As a consequence, the cushion contains the occupant in the wheelchair, for the occupant tends to settle toward the backrest and is not likely to fall forwardly off of the seat. On the other hand, some occupants have enough strength to get into and out of the wheelchair with little assistance, and these occupants generally have the strength to retain themselves on the seat and against the backrest. Even so, lifting off of the seat taxes their energies, but this can be reduced if the cushion A is placed on the wheelchair seat with its long cells 8 adjacent to the back rest and its short cells 4 presented forwardly at the front edge of the seat. Thus, upon leaving— and also entering the seat the— the lowest portion of the cushion A, that is the zone 10 of short cells 4, is presented forwardly where it will, insofar as the cushion A is concerned, offer the least resistance.

Some individuals have skeletal deformities or other infirmities which do not accommodate themselves to level seating surfaces. Indeed, these individuals often experience considerable pain and muscle fatigue when seated on such surfaces. The cushion A, by reason of its wedge-shaped configuration and pressure distribution characteristics, may provide a much more comfortable seating surface for such individuals. With these individuals, the zone 10 of shortest cells 4 should usually be to one side or the other so that the cushion A slopes laterally.

Some of the deformities in posture may be corrected by the application over an extended period of time of restoring forces. The cushion A serves this function as well, since the magnitude of the wedge can in effect be controlled and adjusted by varying the volume of air in the three zones. For example, the wedge has its greatest magnitude or is most pronounced when the pressure in the zone 14 of long cells 8 is greatest and the pressure in the zone 10 of short cells 4 is least. The cushion A when in this configuration may accommodate the patient initially, but to restore the patient to a more normal skeletal condition, the magnitude of the wedge should gradually be reduced, and this is achieved by increasing the pressure in the short cells 4 and decreasing the pressure in the long cells 8. Of course, the transformation, in most instances, takes place incrementally over an extended period of time.

While it is desirable to isolate the cells 4, 6 and 8 of the cushion A in zones 10, 12 and 14, respectively, particularly if the cushion A is used for posture correction, the zones 10, 12 and 14 may all be interconnected, in which case only a single fill tube 34 and valve 36 would be necessary. Also, the zones 10 and 12 may be connected, leaving the zone 14 separate. Other combinations are possible.

A modified cellular cushion B (FIG. 8) possesses a somewhat V-shaped configuration at its supporting surface, and this enables the cushion B to cradle the user and thus confine the user in both lateral directions. The cushion B is quite similar to the cushion A in that it has a base 40 and cells 42, 44 and 46 of three different heights arranged in rows, both longitudinally and transversely, on the base 40. However, in contrast to the cushion A, the cells 42, 44 and 46 are located in five different zones, there being a center zone 50 containing the shortest cells 42, two end zones 52 located along the side edges of the base 40 and containing the longest cells 46 and two intermediate zones 54 located between the center and end zones 50 and 52 and containing the cells 44 of intermediate length. In this connection, the cells 42 when inflated may be about 1 inch high, the cells 44 about 2 inches high, and the cells 46 about 3 inches high..

The zones 50, 52 and 54 may be isolated from each other, in which case they are inflated independently, but in most instances they are all interconnected and are inflated through one fill tube 56 and valve 58 located at one of the corner cells 46. When only one fill tube 56 is used, all of the cells 42, 44 and 46 are interconnected through the base 40 and thus all will carry the same internal pressure. In any event, the cushion B is inflated and adjusted to the proper height using the fill tube 56 and valve 58, all much the same as the cushion A.

The cushion B may be used as a seat cushion or a back rest, and in either case it is oriented such that the zones 52 of long cells 46 are located to the side of the user's body. Thus, the cushion B tends to cradle the user so as to confine the user generally laterally. It thus has good containment characteristics.

Figure 9:
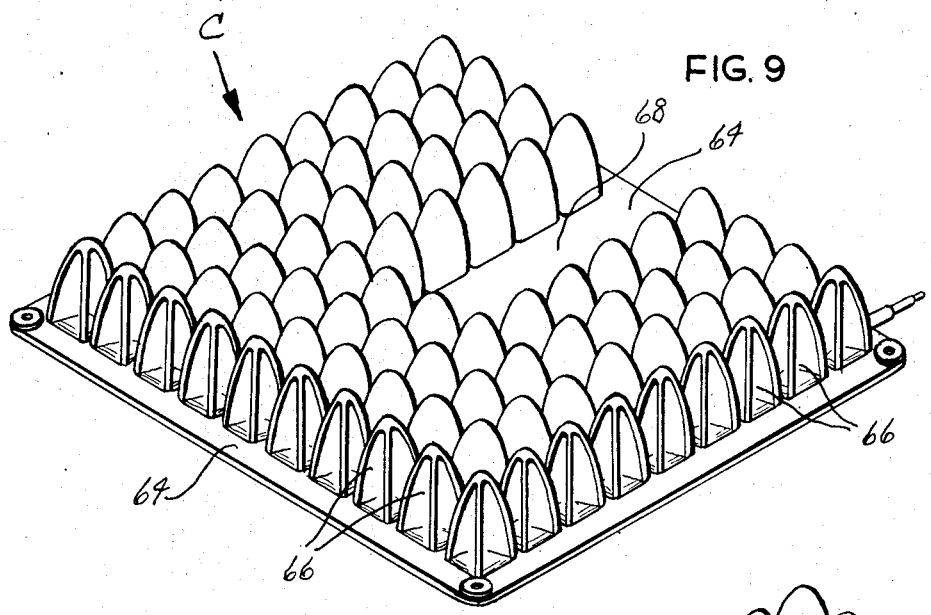
FIG. 9 is a perspective view of another modified cushion having a cavity opening out of one side of the array of cells.

It is possible to provide cellular cushions having cutouts which are useful for a variety of purposes. For example, another modified cellular cushion C (FIG. 9) has a base 64 of rectangular configuration and cells 66 arranged on that base in longitudinal and transverse rows. The cells 66, however, do not cover the entire base 64, and indeed a region midway between the sides of the base 64 and along one of its end margins is left free of the cells 66 to provide a cavity 68 in the array of cells 66. The cavity 68 lies behind extremely sensitive areas— areas which if subjected to any supporting force would cause considerable pain. Of course the location of the cavity 68 to a large measure depends on the particular infirmity with which the user is afflicted, and will therefore vary from user to user. Thus, the cushion C will in many instances be customed designed for a specific user.

Figure 10:
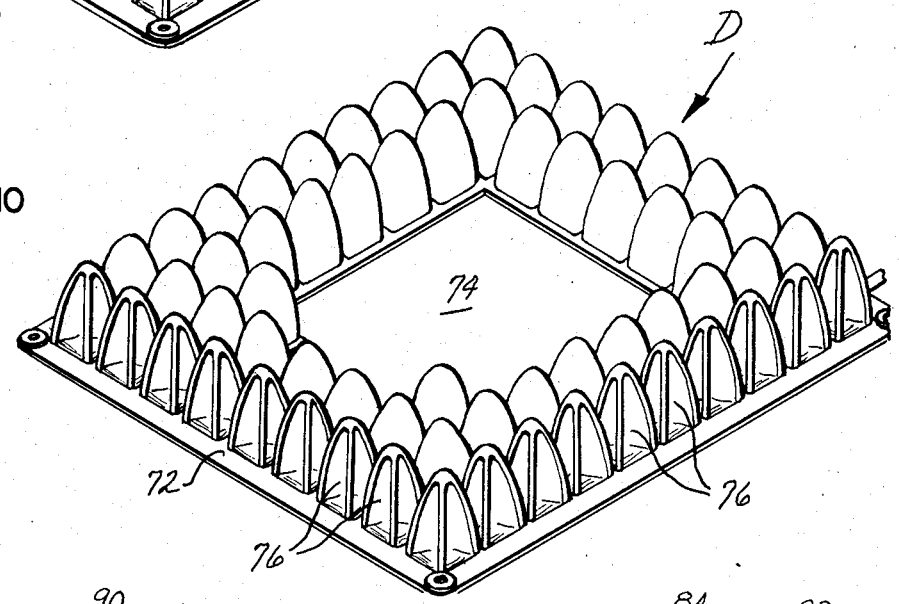
FIG. 10 is a perspective view of yet another modified cushion having its cells arranged around a void that extends completely through the cushion.

In other instances it may be desirable to have the cutout extend completely through the cushion, to perhaps allow the passage of body wastes without contaminating the cushion. For example still another modified cushion D (FIG. 10) has a base 72 of generally rectangular shape, but at its center is completely void, or in other words, has a cutout 74, thus giving the base 72 a somewhat ring-like configuration. The cushion D also has cells 76 which are arranged in longitudinal and transverse rows on the base 72 such that the array of cells 76 is likewise in the ring-like pattern.

Figure 11:
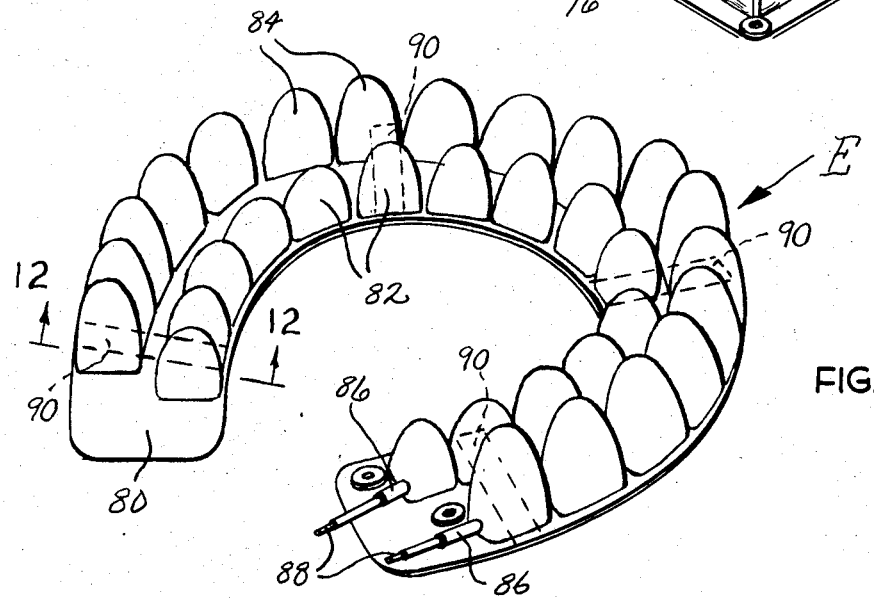
FIG. 11 is a perspective view of a further modified cushion designed to fit onto a toilet seat.

Still another modified cushion E (FIG. 11) is configured to fit into and overlie a conventional toilet seat. As such it possesses a U-shaped configuration. It includes a base 80 which conforms to the toilet seat and cells 82 and 84 arranged in two rows on the base 80. The cells 82 of the first row are shorter than the cells 84 of the second row, and the two rows of cells 82 and 84 are filled with air through separate fill tubes 86 and valves 88. In the alternative, all of the cells 82 and 84 may be in communication and filled through a single fill tube 86, or the cells 82 and 84 on one side may be isolated from the cells 82 and 84 on the other side, that is the cushion E may be divided in half with the cells 82 and 84 on one half being filled through one fill tube 86 and those on the other half filled through another fill tube 86.

Figure 12:
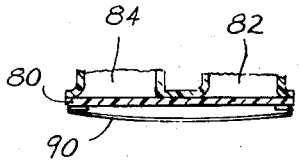
FIG. 12 is a sectional view taken along line 12—12 of FIG. 11 and showing fastening strips used to secure the cushion to a toilet seat.

On the underside of its base 80 the cushion E has flexible strips 90 of Velcro fastening material extending transversely from one margin of the base 80 to the other. The strips 90 are slightly longer than the base 80 is wide and are secured to the base 80 only at their ends, with their ends turned inwardly (FIG. 12). This enables each strip 90 to shift laterally a slight distance with respect to the base 80. The toilet seat on which the cushion E is placed, on the other hand, has more strips of mating Velcro material on it, these strips being about one inch wide and extended generally parallel to the side edges of the seat. Preferably the strips 90 have the hooks and the mating strips of the toilet seat have the loops. Thus, when the cushion E is placed on a toilet seat, the strips 90 on the base 80 of the cushion E overlie the strips on the seat and attach the cushion E to the seat; yet the slight free motion afforded each strip 90 allows the base 80 to seek a level and flat position on the seat.

The cushion E is designed from those individuals who, by reason of injuries to the spinal column, have difficulty effecting bowel movements and must remain on a toilet seat for extended periods of time to achieve a bowel movement. Not only is the cushion E less likely to cause pressure sores, but it further is less restrictive as to the bowel muscles so they contract more easily.

This invention is intended to cover all changes and modifications of the example of the invention herein chosen for purposes of the disclosure which do not constitute departures from the spirit and scope of the invention.

What is claimed is:

1. A cushion comprising a generally flat and thin base formed from a flexible material and containing passageways; a plurality of flexible hollow cells attached to the base and projecting away from it, the cells being detached from each other beyond the base and having sides and outer ends, the cells being expandable laterally when the pressure within the cells is increased, so that the sides of adjacent cells contact each other and the outer ends form a supporting surface, the cells being arranged in two spaced apart end zones, a single center zone located between the end zones, and at least two intermediate zones, with the intermediate zones being located between the center zone and the end zones, the cells of the end zones being longer than the cells of the intermediate zones and the cells of the intermediate zones being longer than the cells of the center zone, whereby the supporting surface formed by the outer ends of the cells possesses a cradle-like contour, the cells of each zone being in communication with each other through the passageways of the base, so that within each zone the cells exist at equal pressure, but the cells of any zone being isolated from the cells of the other zones so that the cells of different zones may exist at different pressures; and means connected with the cells of each zone for admitting an inflating fluid into such cells and for thereafter retaining the fluid in the cells.

* * * * *